US006668719B2

(12) United States Patent
Reder et al.

(10) Patent No.: US 6,668,719 B2
(45) Date of Patent: Dec. 30, 2003

(54) METHOD AND DEVICES FOR ADJUSTING A ROLLER IN A PRINTING MACHINE

(75) Inventors: Wolfgang Otto Reder, Veitshöchheim (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/168,531

(22) PCT Filed: Dec. 16, 2000

(86) PCT No.: PCT/DE00/04503

§ 371 (c)(1),
(2), (4) Date: Oct. 7, 2002

(87) PCT Pub. No.: WO01/49491

PCT Pub. Date: Jul. 12, 2001

(65) Prior Publication Data

US 2003/0089254 A1 May 15, 2003

(51) Int. Cl.[7] ..... B41F 5/00

(52) U.S. Cl. ..... 101/216; 101/247; 101/351.1; 101/218; 101/182; 101/185

(58) Field of Search ..... 101/351.1, 352.02, 101/247, 216, 218, 140, 144, 145, 182, 184, 185, 209, 352.05

(56) References Cited

U.S. PATENT DOCUMENTS

| | | | | | |
|---|---|---|---|---|---|
| 3,570,399 | A | * | 3/1971 | Fink | 101/352.05 |
| 3,731,620 | A | * | 5/1973 | Klemmer | 101/247 |
| 4,214,528 | A | * | 7/1980 | Mirow | 101/247 |
| 4,290,361 | A | * | 9/1981 | Fowler et al. | 101/247 |
| 4,481,882 | A | | 11/1984 | Rudolph | |
| 4,736,678 | A | * | 4/1988 | Stotz | 100/159 |
| 4,993,319 | A | * | 2/1991 | Klappenecker | 101/216 |
| 5,081,927 | A | * | 1/1992 | Jahn | 101/218 |
| 5,094,162 | A | | 3/1992 | Tafel | |
| 5,109,768 | A | * | 5/1992 | Lübke et al. | 101/247 |
| 5,181,468 | A | * | 1/1993 | Borel | 101/247 |
| 5,355,796 | A | | 10/1994 | Kobler et al. | |
| 5,485,785 | A | | 1/1996 | Schneider et al. | |
| 5,967,043 | A | | 10/1999 | Mayr | |
| 6,085,651 | A | * | 7/2000 | Defrance et al. | 101/247 |

FOREIGN PATENT DOCUMENTS

| | | |
|---|---|---|
| DE | 708 553 | 7/1941 |
| DE | G 83 13 742 U1 | 2/1990 |
| DE | 42 11 379 A1 | 10/1993 |
| DE | 42 32 163 A1 | 3/1994 |
| DE | 42 32 163 C2 | 6/1995 |
| DE | 197 19 305 A1 | 11/1998 |
| DE | 197 40 480 A1 | 3/1999 |
| DE | 199 19 733 A1 | 11/1999 |
| EP | 0 653 302 A1 | 9/1994 |
| EP | 0 826 501 A1 | 9/1996 |
| EP | 0 807 520 A2 | 5/1997 |
| WO | WO 92/04188 | 3/1992 |

* cited by examiner

*Primary Examiner*—Eugene H. Eickholt
(74) *Attorney, Agent, or Firm*—Jones Tullar & Cooper PC

(57) ABSTRACT

An adjustable bearing arrangement is used for the remote controlled adjustment of an inking roller or a dampening roller with respect to a second, contacting roller. The journal of the roller to be adjusted is secured to an adjusting element. A pre-settable adjusting force is transferred from one roller to the other. In the adjustment position, the receiving element or elements are locked so that it is temporarily impossible for the now adjusted roller to move either in, or opposite to the direction of adjustment.

15 Claims, 3 Drawing Sheets

METHOD AND DEVICES FOR ADJUSTING A ROLLER IN A PRINTING MACHINE

FIELD OF THE INVENTION

The present invention is directed to a method and to devices for adjusting a roller of a printing press. The roller is placed against another roller and a movable detent is used to hold it in place.

BACKGROUND OF THE INVENTION

A device for adjusting a roller of an inking or dampening unit of a printing press, with respect to an adjoining roller, has become known from EP 0 826 501 A1.

DE 199 19 733 A1 discloses a device for setting the contact pressure between two rollers of a printing press. A spring force is applied to a first roller and it is fixed in place on a frame by an arresting device.

DE 197 19 305 A1 discloses a bearing arrangement for a roller of an inking or dampening unit. A roller holder can be positioned by use of a spring, and can be fixed in place by being clamped.

DE 42 32 163 C1 describes a device for maintaining a set positioning pressure of an inking roller by use of a temperature-dependent actuator.

EP 0 807 520 A2 shows a switching arrangement for printing cylinders with a double-acting work cylinder.

EP 0 653 302 A1 and DE 42 11 379 A1 disclose devices for adjusting a roller, wherein a work cylinder presses a roller against a mechanically displaceable detent.

SUMMARY OF THE INVENTION

The object of the present invention is directed to creating a method and devices for adjusting a roller of a printing press.

In accordance with the present invention, this object is attained by placing the roller against at least one other roller through the use of a positioning force. A detent, which limits the positioning path of the roller, is placed against the roller or a receiver of the roller. A motor can be used for displacing the detent. The motor or other operating device can apply two different forces acting on the roller, a first for production and a second for positioning.

The advantages which can be gained by the present invention consist, in particular, in the compact construction of the device. In this case, the diameter of each device is equal to or preferably less than the diameter of the cylindrical shell of the roller of the inking or dampening unit. For this reason, no hindrance between these devices will be a problem when several such devices are used next to each other, for example in the situation of two adjoining inking rollers with a riding roller placed thereupon as the third roller—wherein all rollers are adjustable.

A preselectable positioning pressure of the inking or dampening unit roller is made dependably possible by utilization of a preselectable force that is generated, for example, by an operating device for linear movement—such as, for example, a motor for linear movements, i.e. a cylinder with a pistol; piezo-operating devices, electrochemical operating devices, etc.—gaseous or liquid media, or electrical current. This adjustment is reproducible, i.e. flattening of a rubber covering of a dampening or inking roller thus forming a roller strip. This means that the so-called "inking or dampening roller strips" can be kept at a constant width by the flattening of a rubber covering of a dampening or inking roller.

It is not possible to affect a so-called "channel beat" when the inking or dampening roller rolls over a gap on other rollers. The fixing pressure $P_F$, and therefore the fixing force $F_F$ with which the roller journal of the inking or dampening roller is held in a fixed manner, can only be set to be larger by a multiple of the positioning pressure $P_A$, and therefore also a multiple of the positioning force $F_A$, with which the covering of the roller is pressed against the shell of an immediately adjoining cylinder or roller.

A rapid pre-adjustment of the rollers, also for compensating for changes in diameter in the course of production, and/or in case of changes in the Shore hardness of the rollers, is possible. Because of this the set-up times become negligibly small. It is also possible to adjust these rollers remotely, for example centrally from a press control console.

The receiver of the roller or rollers can be maintained "locked in" during the entire running time. A high degree of quiet running of the rollers is assured by this, even when the printing press is running, because the "swing-up" of vibrations at the roller journals/-shafts is not possible because of the application of a clamping effect or a blocking effect. By acting on the distributing cylinder with a fixing pressure $P_F$, or a fixing force $F_F$, which is/are greater by a multiple than the positioning pressure $P_A$, or the positioning force $F_A$, a detent, which follows the performed positioning, is pressed against a counter-bearing fixed in place on the frame so strongly that, with the prevailing operational state of the roller positioning, an unintentional movement of the positioned roller in, or opposite to the roller positioning direction E is impossible.

BRIEF DESCRIPTION OF THE DRAWINGS

Preferred embodiments of the present invention are represented in the drawings and will be described in greater detail in what follows. Shown are in.

DESCRIPTION OF THE PREFERRED EMBODIMENTS

Figure 1:
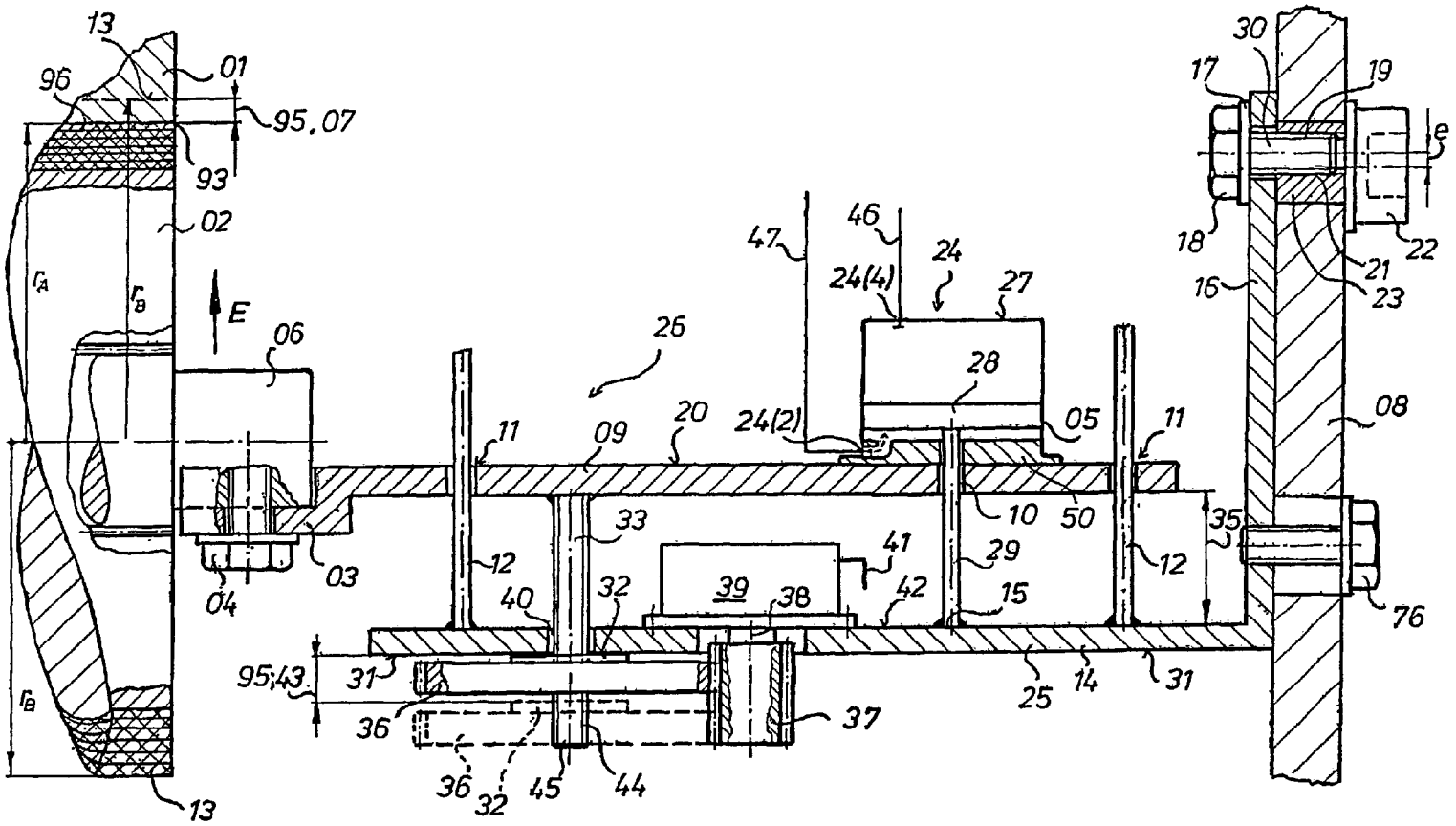
FIG. 1, a side elevation view, in the positioning position, with the clamping opened (principal representation), on the ends of two adjoining rollers, whose first roller can be moved to position the second roller by use of the device in accordance with a first preferred embodiment of the present invention, FIG. 2, a second preferred embodiment of the device in accordance with FIG. 1, and in FIG. 3, a pneumatic switching diagram for controlling the device in FIGS. 1 and 2.
Figure 2:
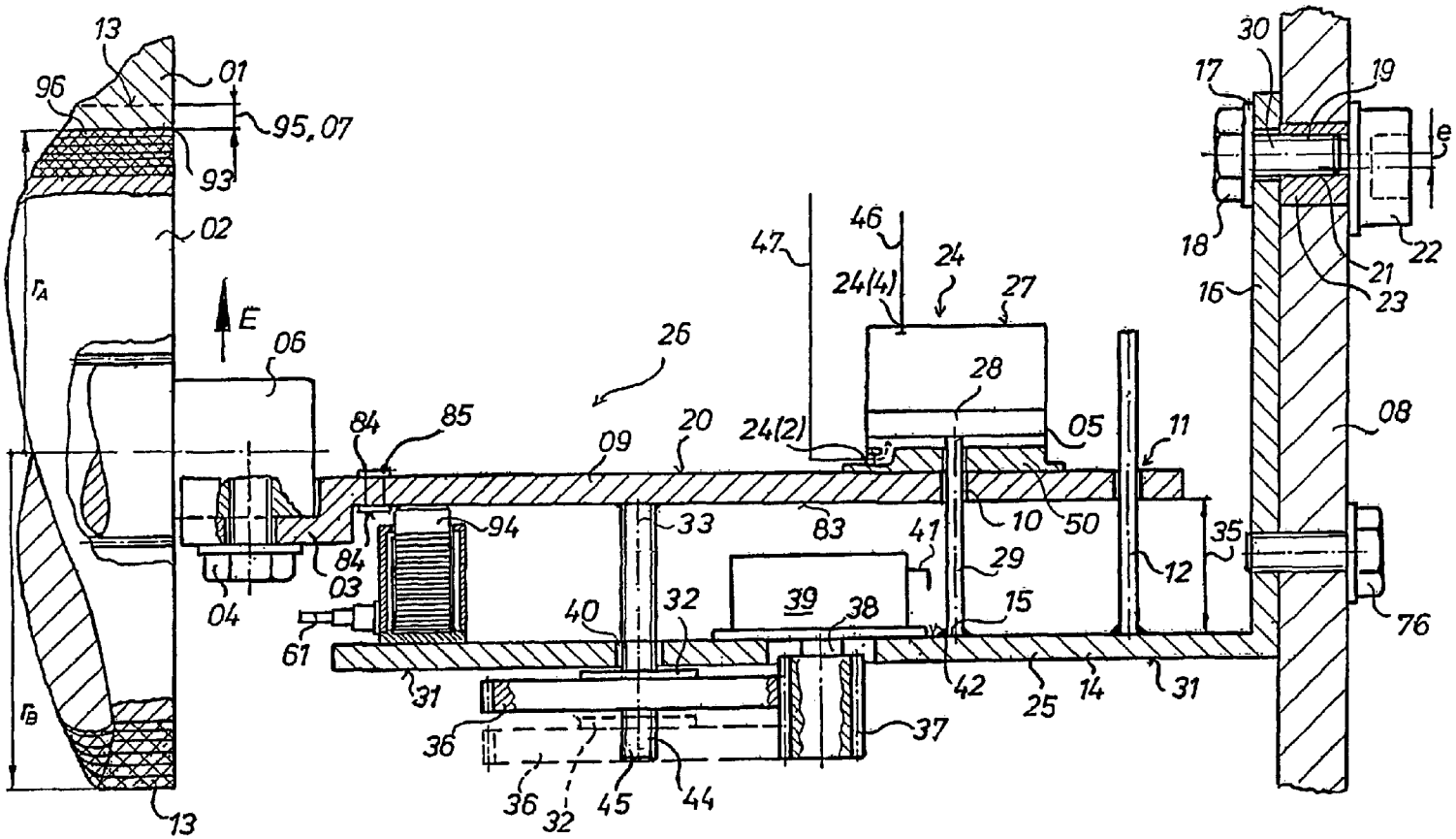

A first roller or cylinder 01 of an inking or print unit of a printing press is seated pivotably or fixedly in lateral frames as seen in FIGS. 1 and 2.

Against this first roller 01, a second roller 02 having a shell 05 of a flexible, such as a rubber-elastic or elastomeric plastic material, for example rubber or other rubber-like material, can be placed by use of a movable, for example a shell-shaped journal receiver 03 or a shaft receiver which will be called "receiver" for short in what follows.

The shiftable roller 02 is rotatably seated at both ends on respective bearing shafts 06 by friction or rolling bearings. Each bearing shaft 06 is fastened, fixed against relative rotation, on a journal receiver 03, for example by use of a screw or bolt 04. This is accomplished by turning the screw or bolt 04 through a bore in the journal receiver 03 into a threaded bore in the journal 06. Instead of seating or supporting the shiftable roller 02 on shafts 06, it is of course also possible to provide the seating for roller 02 by the use of journals 06 that are attached by material-to-material contact to the roller 02. However, it would then be necessary to arrange bearings on the receiver 03.

The bearing journals 06 of the roller 02 are fastened in the shell-shaped journal receivers 03 which are assigned to each.

The journal receiver 03 is fastened on a set plate 09, for example is welded to it. The set plate 09 has a plurality of guide bores 11. In addition, a plate drive mechanism 24 or operating device is provided on set plate 09, which drive mechanism 24 is fastened to set plate 09 by a housing 05.

The plate drive mechanism 24 or operating device can be provided as a motor for rotary movements—such as an electric, pneumatic or hydraulic motor, for example—, or also as a motor for linear movements—such as a work cylinder with a piston, a linear motor, a d.c. magnet, a piezo-operating device, or as an electrochemical operating device, for example—.

In this connections, it is important that torque, power or output of the operating device 24 can be adjusted.

In the first preferred embodiment the drive mechanism 24 is designed as a motor for linear movement. A double-acting work cylinder 27 is used for this, on which a gaseous or a liquid medium, for example air or oil, can act. The housing 05 of the drive mechanism 24 or operating device, for example a work cylinder 27, is fastened on a top surface 20 of the set plate 09 with its piston rod side 50 pointing downward.

A piston rod 29 of a piston 28 of the work cylinder 27 projects downward through a bore 10 of the set plate 09. Its free end 15 is rigidly or flexibly fastened on a horizontal leg 25, or base plate 25 of a support elbow 14.

A vertical leg 16 of the support elbow 14 can be adjusted up and down in the vertical direction and can be fixed in place on the inside of a machine frame 08 of a print unit or ink unit.

The above described device, called "device for adjustment 26" as a whole, can also be arranged inside an opening or bore in the lateral frame 08 and can be supported thereon.

An eccentric bushing 23, which is seated in the machine frame 08 so it can be rotated and fixed in place and has an eccentricity "e", is used for the vertical adjustment of the adjustment device 26. The eccentric bushing 23 has a hexagonal adjustment head 22 seated on the exterior, by use of which, a rotating movement can be introduced into the eccentric bushing 23 by utilization of a wrench.

A device 17 for arresting of the eccentric bushing 23 is furthermore provided. It can consist, for example, of a ratchet screw 18 with a smooth shaft 30 and a threaded part 19. The threaded part 19 is in engagement with an interior screw thread 21 of a bore of the eccentric device 23. The ratchet screw 18 can be tightened so securely that the set position of the vertical leg 16, and therefore the position of the adjustment device 26 can no longer be changed. The vertical or leg 16 has been threaded on the shaft 30 by its bore which is matched to the diameter of the shaft 30. It is possible to provide a ratchet screw 76 for additional securement, which ratchet screw 76 is screwed through a slit in the machine frame 08 into a second, lower threaded bore in the vertical or fastening leg 16 that is resting against the lateral frame 08, as seen in FIGS. 1 and 2. It is possible to securely press the leg 16 against the inner surface of the machine frame 08.

A plurality of vertically oriented guide rods 12 are fastened, for example by being welded, to a top side 42 of the horizontal leg or base plate 25. The guide rods 12 have the job of making possible, in cooperation with tightly matched guide bores 11 on the set plate 09 movement of the set plate 09 vertically up or down along the guide rods 12 and in this way to achieve a change in a spacing distance 35 between the base plate 25 and the set plate 09.

An upper end of a rod 33, which rod 33 is oriented downwardly and at right angles to the set plate 09 and which has an exterior screw thread 44, is welded to the underside of the set plate 09. Lower, free end 45 of rod 33 extends freely downward, for example by 20 mm, through a bore 40 in the horizontal leg or base plate 25 of the support elbow 14.

A detent 32, for example in the shape of a disk, has been threaded on the free end 45 of the rod 33. The distance of this detent 32 along the rod 33 can be adjusted in relation to the underside 31 of the base plate 25 along the rod 33 because rod 33 is, for example, a threaded rod. This can take place, as represented in the preferred embodiments, for example, by providing the detent 32 as a driveable adjusting nut 32, which can be turned in a clockwise or in a counterclockwise direction on the screw thread 44 of the free end 45 of the rod 33.

Instead of moving the detent 32 along the free end 45 of rod 33, the detent 32 can also be fastened, fixed against relative rotation, on the free end 45 of the rod 33, and the rod 33 can be arranged so that it can be moved back and forth and can be fixed in place. For example, this could take place in such a way that the rod 33 is provided with an exterior screw thread 44, which is in engagement with a screw thread in a bore in the set plate 09. An end of the rod 33, which extends at the top above the set plate 09 can be connected with a drive mechanism which can be changed from running toward the right to running toward the left, for example an electric motor or a pneumatic motor, for example a step motor. The use of a servo valve would also be conceivable.

The detent 32 is driven by being structured as a disk-shaped detent 32, as seen in FIG. 1, which can be moved along the length of the free end 45 of the threaded rod 33 via a threaded connection.

To this end, the detent 32 itself is provided, for example, with a first gear rim 36 or with a gear wheel 36. The teeth of the gear rim, or the gear wheel 36 are in engagement with teeth of a driving gear wheel 37 which, the same as the detent 32, is arranged underneath the horizontal leg or base plate 25. The width of a tooth face of the driving gear wheel 37 is a multiple of the width of the tooth faces of the teeth of the gear rim 36.

The detent 32, which is embodied as a hub with the gear rim 36, or as a part of the gear wheel 36, can be moved along a predefined adjustment length of the threaded rod 33 without the engagement of the teeth of the gear wheel 36 and the driving gear wheel 37 being lost.

The driving gear wheel 37 is connected, fixed against relative rotation, with a detent drive mechanism 39 or operating device, whose direction of rotation can be reversed, for example a motor for rotary movements such as an electric, step, hydraulic, or pneumatic motor via the driveshaft 38 of the drive mechanism or operating device 39.

Depending on its configuration, the drive mechanism or operating device 39 is fastened, for example, on the top 42 of the base plate 25—i.e. in the space between the set plate 09 and the base plate 25—, or on an underside 31 of the base plate 25. The driveshaft 38 with the driving gear wheel 39 projects downward through a bore in the base plate 25 when the drive mechanism or operating device 39 is fastened on the top 42 of the base plate 25.

In the preferred embodiment in accordance with FIG. 1, the detent 32—in this case structured as a hub of the gear wheel 36, can be rotated by the driving gear wheel 37. Depending on the direction of rotation of the gear wheel 36, and therefore of the detent 32, detent 32 moves along the screw thread 44 of the rod 33 toward or away from the underside of the base plate 25. Detent 32 can be stopped and fixed in place on the rod 33 at any distance from the underside 31, but can also be stopped when it is touching the underside 31 of the horizontal leg or base plate 25.

Depending on the preferred arrangement, the detent 32 can be supported either on the base plate 25, or alternatively on the set plate 09.

An essentially step-free pressing—as a function of a pressure force $F_A$ introduced into the set plate or receiver 09—of two immediately adjoining rollers 01 and 02 against each other is possible by utilizing the method and the devices in accordance with FIGS. 1 and 2. In this case, the movable or shiftable roller 02, which is to be placed against the first or fixed roller 01, and therefore also the set plate or receiver 09—travels at least a positioning length to a final placement of the shiftable roller 02. An indentation depth 07 in the, for example, highly elastic, or rubber-elastic or elastomeric shell 13 of one of the two rollers 01, 02, or the width of the so-called roller strip defined by the deformations of the rollers 01, 02 placed against each other, is a measure of the pressure, which is a function of the pressure force $F_A$. At least one of the two rollers 01, 02 must have a rubber-elastic or highly elastic or elastomeric cover or shell 13.

To adjust the positioning pressure between the two rollers 01, 02, at least one of the two rollers 01, 02 must be arranged so it can be placed against, or moved away from the other roller 02, 01, i.e. it must be able to perform a lift or displacement distance 95 which is greater than the maximally attainable depth 07 of the indentation into the shell 13 of the opposing one of rollers 01, 02. With rollers 02 and 01 pressed against each other, the shell 13 of one or both of them is compressed by the amount $r_b - r_a$ (ΓB−ΓA), which amount equals the indentation depth 07, and results in the partially indented or compressed shell 96.

The positioning of the shiftable roller 02 takes place through its two bearing shafts 06, only one of which is represented. However, an over mounted seating would also be possible, so that there would only be one bearing shaft, or bearing journal 06, per roller 02.

For this reason one device 26 for adjusting an inking or dampening unit roller 01, 02 per bearing shaft 06, each with one journal receiver 03, and each with an available lift 95 and a presettable positioning force $F_A$ and fixing force $F_F$, is advantageous.

The limit of the lift 95 of the roller 02 to be adjusted can be set in a step-free manner. This takes place by the change of position of the detent 32 on the rod 33 in the direction of the longitudinal axis. Expressed differently, the position of the detent 32 of the set plate 09 in relation to the base plate 25, which is fixed on the frame 08, can be adjusted and set.

Before the roller 02 can be placed against the roller 01 with a preselected positioning pressure $P_A$, or positioning force $F_A$, the detent 32, which may be configured as an adjusting nut, must be placed a sufficiently large distance 43 away from a stop face 31 fixed on the frame; in this case at a distance 43 from the underside 31 of the base plate 25. In this context see the gear wheel 36 and the detent 32 shown in dashed lines in FIG. 1. To do this, the gear wheel 36 with the detent 32 is rotatingly driven by the drive mechanism 39, 37 in such a way that it will have been moved along the screw thread 44 of the rod 33 from the stop face 31 to a preselectable distance 43, which, in this case, would correspond to the maximally achievable lift 95.

In the course of the above described process, or after its termination, the drive mechanism 24 now moves the set plate 09 with the journal receiver 03, at a preset positioning force $F_A$, away from the base plate 25, which base plate 25 is fixed in place in the machine frame 08 and is directly or indirectly supported in the machine frame 08. The shiftable roller 02 with its, for example, rubber-elastic shell 13 also follows this movement in the direction toward the roller 01. The shiftable roller 02 with the shell 13 is moved, resting against the shell of the roller 01, with a preset positioning force $F_A$ until it is at equilibrium with the reaction force with its positioning being determined as a function of the positioning force $F_A$.

Thereafter, the gear wheel 36 is driven and the detent 32 is moved in the opposite direction of rotation until, at the end, it comes into contact by means of a torque, or force, which can be preset by means of the drive mechanism 39, and is slightly tightened. The drive mechanism 39 is immediately stopped and the positioning pressure $P_A$, or the positioning force $F_A$, is increased by a multiple of $F_A$, for example four times $F_A$ by operation of the drive mechanism 24, and in this way a preset fixing force $F_F$, or fixing pressure $P_F$, is achieved. The detent 32 is pressed, or pulled, even more strongly against the stop face 31 by the increased fixing force $F_F$, because the drive mechanism 24 acts in a manner in which the set plate 09 and the base plate 25 are moved away from each other. In this operational position, a change of the shaft distances at the rollers 01 and 02 in the direction toward the roller 01 is practically no longer possible. Thus, the ability of the receiver 03 to move is blocked.

In the course of a new setting of the positioning force $F_A$, or when moving the roller 02 away from the roller 01, the positioning pressure/force $P_A/F_A$ is set to zero. Thereafter, or simultaneously, the detent 32 is brought into a preselectable distance 45 from the stop face 31 by operation of the gear wheel 36, which is now moved backwards by the drive mechanism 39 and is stopped; the positioning pressure/force $P_A/F_A$, or the fixing pressure/force $F_F/F_F$, are reversed in their direction. Through this step, the detent 32 achieves, in the end, a sufficient distance 43 from the stop face 31, and the roller 02 is moved away from the roller 01.

Another adjustment possibility would be a "distance-dependent" positioning. For this, the detent 32 is initially brought to a preselected distance 43 in respect to the stop face 31.

Thereafter, the set plate 09 with the threaded rod 33, the detent 32, and the gear wheel 36 are moved by operation of the drive mechanism 24 at a preset force, for example at a fixing pressure/force $F_P/F_F$ ratio, away from the base plate 25 fixed on the frame 08 until, in the end, the detent 32 comes into contact with the stop face 31. This fixing pressure/force $F_P/F_F$ is applied during the entire operating time. If the roller 02 is to be moved away, the direction of the fixing pressure, or of the fixing force, is reversed and the set plate 09 is pulled in the direction toward the base plate 25.

However, a version is also possible, in accordance with which the detent 32 is fastened in a movable and arrestable manner on a part—for example on the guide rod 12—of the base plate, and namely between the set plate 09 and the base plate 25, or on a free end of the guide rod 12 passed through the guide bore 11.

While the position of the detent 32 can be adjusted by the detent drive mechanism 39 or operating device, the plate drive mechanism 24 or operating device is provided for moving the set plate 09. In the preferred embodiment, the plate drive mechanism 24 is embodied, for example, as a double-acting pneumatic or hydraulic cylinder 24 or servo cylinder 24 with a piston chamber connector 24(4) and with a piston rod chamber connector 24(2).

Figure 3:
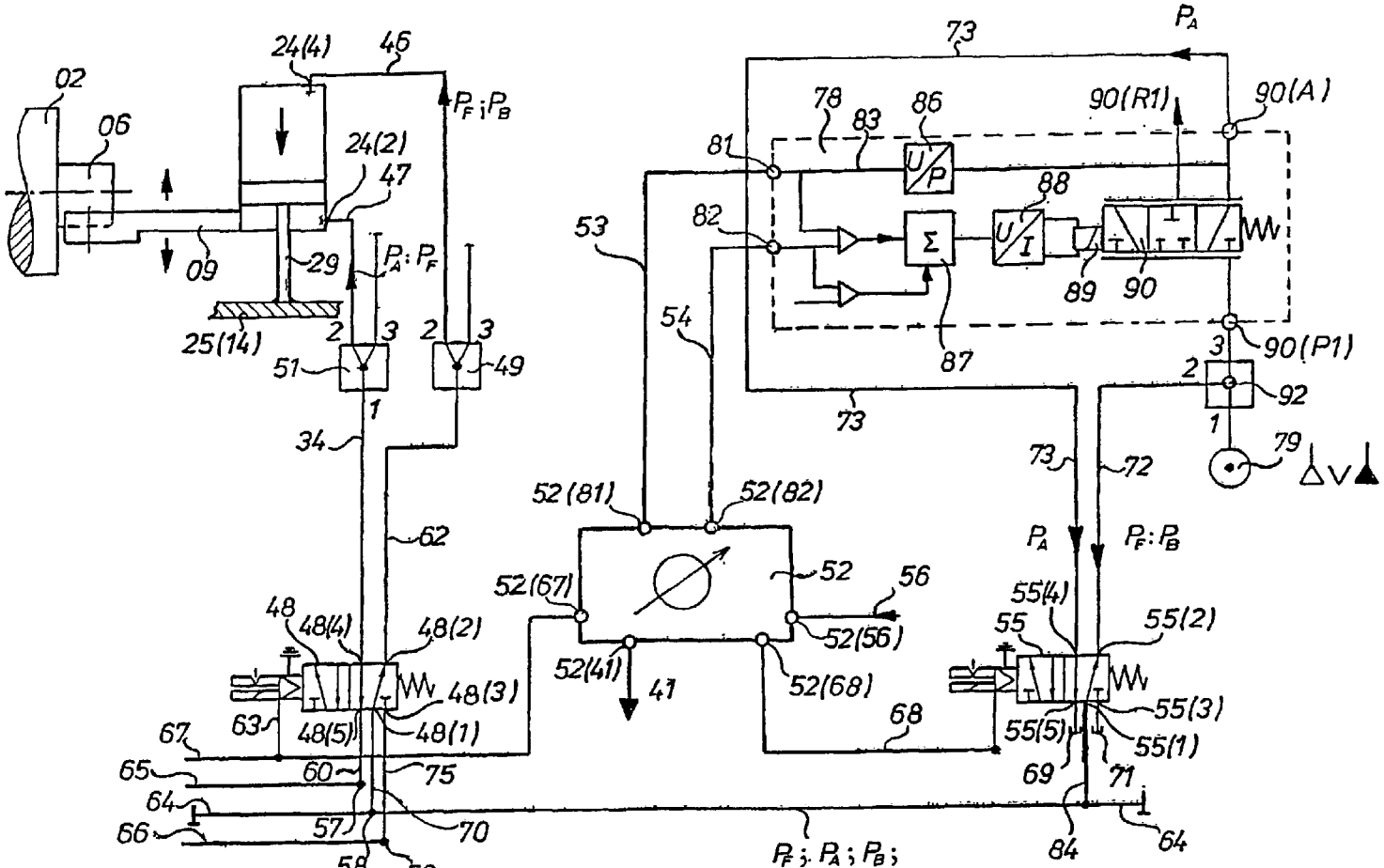

The piston rod chamber connector 24(2) is connected by a pneumatic, or hydraulic line 47 with a first branch connector 51(2) of a first pneumatic, or hydraulic distributor 51, as seen in FIG. 3. A second branch connector 51(3) is either connected with a piston rod chamber connector of a further servo cylinder, or it is closed.

A feed connector 51(1) of the first distributor 51 is connected by a pneumatic, or hydraulic line 34 with a connector 48(4) of a first 5/2-way directional control valve 48, which is used as the "pressure" or "positioning" valve. A connector 48(5) of the directional control valve 48 is connected via a pneumatic, or a hydraulic intermediate line 60 with a first exhaust line 65 via a connector 57.

The piston chamber connector 24(4) of the cylinder 27 of the plate drive mechanism 24 is connected by a pneumatic, or hydraulic line 62 with a first branch connector 49(2) of a second pneumatic, or hydraulic distributor 49. A second branch connector 49(3) is either connected with a piston chamber connector of a further servo cylinder, or it is closed.

A feed connector 49(1) of the second distributor 49 is connected with a connector 48(2) of the 5/2-way directional control valve 48 by a pneumatic, or hydraulic line 46. A connector 48(1) of the 5/2-way directional control valve 48 is connected by a pneumatic, or hydraulic line 70 via a connector 58 of a second pneumatic, or hydraulic pressure feed line 64, such as a pipeline or hose.

A first, admission connector 48(3) is connected by a pneumatic, or hydraulic line 75, a pipeline or hose via a connector 59 with a second exhaust line 66, a pipeline or hose.

An electro-pneumatic, or electro-hydraulic pressure control valve 78, called an "E/P pressure control valve" for short in what follows, is provided for supplying the pneumatic or hydraulic cylinders 27 with compressed air, or a pressure medium, for generating the positioning pressure $P_A$. In accordance with an analog electrical reference variable, which can be remotely adjusted, this E/P pressure control valve 78 selects a pressure $P_A$, which for example is proportional to the reference variable.

The integrated electronic device of the E/P pressure control valve 78 performs a comparison between the set positioning pressure reference variable and the actual positioning pressure $P_A$ in the work line 73 (actual pressure value), which is detected by a piezo-resistive pressure sensor 86.

A regulator 87 generates a manipulated variable, with which a 3/3-way directional control valve 90 is controlled via a clocked U/I converter 88 and a proportional magnet 89, so that the preset "positioning pressure" $P_A$ is available at the connector 90(A) of the 3/3-way directional control valve. The work line 73 which is a pipeline or hose, is connected with its first end to the connector 90(A) of the directional control valve 90.

A second end of the work line 73, which is a pipeline or hose, is connected to a connector 55(4) of a second 5/2-way directional control valve 55.

From a fluid pressure source 79, as seen in FIG. 3, and via an input 92(1) of a distributor 92, a gaseous or liquid fluid such as air or hydraulic fluid charged with an operating positioning pressure $P_B$, which can be the fixing pressure $P_F$ at the same time, for example 6 to 12 bar, reaches a connector 90(P1) of the 3/3-way directional control valve 90 of the electro-pneumatic or hydraulic pressure control valve 78 through a first outlet 92(3) of the distributor 92. A second outlet 92(2) of the distributor 92 is connected via a work line 72, which is a pipeline or hose, with a connector 55(2) of the second 5/2-way directional control valve 55, having two flow-through through positions connectors, two switching positions, actuation by a proportional magnet and restoring spring and lock-in position.

A connector 55(1) of the second 5/2-way directional control valve 55 is connected, via an intermediate line 84, to the pressure feed line 64. The connectors 55(5) and 55(1) of the directional control valve 55 are closed by closures 69 and 71.

In the first switching position, the "fixing position", represented in FIG. 3, of the second directional control valve 55 a higher pressure, the "fixing pressure" $P_F$, for example the positioning operating pressure of 10 bar, is present at the connector 48(1). In the second switching position, the "positioning position", of the second directional control valve 55, the "positioning pressure $P_a$", is present at the connector 48(1). As a rule, this is lower than the "fixing pressure $P_F$". The "positioning pressure $P_a$" can be regulated and can be kept constant at, for example, 0.1 to 8.0 bar, by the pressure control valve 78.

In a first position, the "fixing position" of the 5/2-way directional control valve 55, a flow connection is made between the connectors 55(2) and 55(1).

Thus, the higher "fixing pressure $P_F$" now prevails in the feed line 64.

In a second position, the "positioning position" of the second 5/2-way directional control valve 55, a flow connection is provided between the connectors 55(4) and the connector 55(1). Thus, the lower "positioning pressure $P_a$" now prevails in the feed line 64.

The directional control valve 48 also has two positions. A second position, the so-called "positioning position", and the first position, the so-called "moved-away position", as represented in FIG. 3.

The connectors 48(4) and 48(1) of the directional control valve 48 are switched to flow-through in the "positioning position"; the connectors 48(2) and 48(3) are also so switched. In that case, the piston rod chamber of the servo cylinder 24 is then charged, depending on the switching position of the directional control valve 55, either with the lower positioning pressure $P_A$, or with the higher fixing pressure $P_F$, over the path 24(2), 47, 52(2), 51(1), 34, 48(4), 48(1) and the feed line 64.

In this case, the piston chamber of the servo cylinder 24 is vented via 24(4), 46, 49(2), 49(1), 62, 48(2), 48(3) and the exhaust line 66.

In the "positioning position", it is achieved that via the set plate 09, the shiftable roller 02 is pressed against the fixed (a second roller 01 with a pressure $P_A$—for example 2 bar—, which can be preselected and kept constant. In the course of this, a flattening, or measurable width, or indentation depth 07, of the cover, or in the cover of the elastomeric shell 13 of the cylinder 02 is achieved. This can be changed, i.e. can be set, as a function of the selected positioning pressure $P_A$.

In the "moved-away position" the roller 02 is moved away from the roller 01. In this case, the second directional control valve 55 has been switched in such a way—flow-through between the connectors 55(2) and 55(10—that the high operating pressure $P_B$, which can be equal to the fixing pressure $P_F$, is present in the feed line 64.

The directional control valve 48 is in the "moved-away position", as represented in FIG. 3. The connectors 48(2) and 48(1) on the one hand, and the connectors 48(4) and 48(6) on the other hand, have been switched to flow-through. It follows from this, that the full pressure $P_F$, or $P_B$, prevails in the piston chamber of the double acting work cylinder 27, and the set plate 09 with the cylinder 02 fastened thereon is moved away from the cylinder 01 for a predetermined distance. Venting is performed via the connectors 48(4) and 48(5) over the line 60 and the first exhaust line 65. At the end of this process, the shiftable cylinder 02 is in the "rollers off position".

All drive mechanisms and operating devices, such as the above described drive mechanisms 24, 39 and also the to be depicted drive mechanism 94, can be controlled from a central machine control console via a central electronic control device 52, for example, a computer 52. as described in FIG. 3. Moreover, the reference variables for the presettable pressures $P_A$ and $P_F$ can also be set. The switching of the directional control valves 48, 55 is performed following the input of the command "position" in the correct sequence from the "position pressure $P_A$" to "fixing pressure $P_F$". For this purpose, the electromagnets of the directional control valves 48, 55 are connected via the connectors 52(68) and 52(67) and via electrical control lines 67, or 68. The actual value output 81 is connected via an electrical connecting line 53 and a connector 52(81) with the control device 52, and the reference variable input 82 is connected via an electrical connecting line 54 and a connector (52/82) with the control device. The voltage supply 56 of the control unit 52 takes place via its connector 52(56). A sufficient number of displays of the set reference pressure and of the actual pressure are provided at the machine control console.

Prior to the automatic application of the fixing pressure $P_F$, the detent drive mechanism 39 is charged in such a way that the detent 32 rests against its associated stop face 31, or 42, or 20, and that it switches off when a preselected torque or motor current, for example, has been reached. The detent drive mechanism 39 can be regulated to run in the right or left direction by the control device 52 via the electrical feed line 41. Because of this, the release of the blockage of the base plate 25 when adjusting the positioning force $F_A$, or after the command "roller off", can be performed.

It lies within the scope of the present invention that generating the positioning force $F_A$ is not limited to pneumatic or hydraulic drive mechanisms 24. Piezo-electrical or electro—chemical operating devices are also suitable. As represented in FIG. 2, the top 42 of the base plate 25 is used as an abutment, and the underside 83 of the set plate 09 as the force application point for the operating device 94. For its control, the operating device 94 is connected via an electrical connecting line 61 with the control device 52.

A pressure measuring arrangement 84, with its electrical connector 85, is arranged on the set plate 09 for the purpose of actually measuring the positioning force $F_A$ exerted by the operating device 94. It is used for measuring the actual value of $F_A$. The pressure measuring arrangement 84 can consist, for example, of strain gauge strips in a Wheatstone bridge circuit. In this case, the branches of the bridge are then placed on the top 20 and on the underside 83 of the set plate 09 in the vicinity of the shaft receiver 03. Blocking and unblocking of the set plate 09 by use of a detent 32 takes place as described above in the other preferred embodiment.

In the situation of an over-mounted seating, a device 26 for adjusting the pressure force $F_A$, or fixing force $F_F$ for each roller 02 to be positioned for each bearing journal, or bearing shaft 06, is provided. If the positionable roller 02 is not seated over-mounted, two devices 26 are provided, which can be selectively preset and/or switched in singly or together, so that they act on one or both shaft receivers 06 per roller 02.

While preferred embodiments of a method and of devices for adjusting a roller in a printing machine, in accordance with the present invention, have been set forth fully and completely hereinabove, it will be apparent to one of skill in the art that changes, in for example the drive for the cylinders or rollers, the specific type of printing press and the like could be made without departing from the true spirit and scope of the present invention, which is to be limited only by the following claims.

What is claimed is:

1. A method for adjusting a position of a roller in a printing press including:

providing a first roller movable along a positioning path;

providing a second roller;

moving said first roller along said positioning path:

placing said first roller in contact with said second roller;

using a positioning force and forcing said first roller against said second roller by moving said first roller along said positioning path in response to said positioning force;

providing a detent;

using said detent for limiting said movement of said first roller along said positioning path of said first roller; and engaging said detent with said first roller subsequently to forcing said first roller against said second roller using said positioning force.

2. The method of claim 1 further including initially spacing said detent and said first roller at a distance.

3. The method of claim 1 further including presetting said positioning force.

4. A method for adjusting a roller in a printing press including:

supporting said roller for movement in the printing press;

providing an operating device for moving said roller;

applying a first force on said roller using said operating device during positioning of said roller;

applying a second force on said roller using said operating device during production of the printing press;

providing a detent; and using said detent for limiting movement of said roller subsequently to applying said first force to said roller during said positioning of said roller.

5. The method of claim 4 further including providing said first force less than said second force.

6. The method of claim 4 further including providing a servo cylinder and using said servo cylinder for applying said first and said second forces.

7. The method of claim 6 further including charging said servo cylinder with a hydraulic fluid.

8. A method for adjusting a roller of a printing press including:

supporting said roller for movement in the printing press;

providing an operating device for generating a positioning force for said roller;

providing an adjustable detent for limiting said movement of said roller;

providing a detent adjusting motor;

using said motor for adjusting said detent; and providing said positioning force for said roller greater than a counter force applied by said detent because of said detent adjusting motor.

9. The method of claim 8 further including providing said counter force supplied by said detent adjusting motor as an adjustable force.

10. The method of claim 9 further including providing said detent adjusting motor with torque and output and presetting said torque and output.

11. The method of claim 9 further including providing a production force for said roller, said production force being greater than said positioning.

12. A method for adjusting a position of a roller in a printing press including:

placing a first roller in contact with a second roller;

using a positioning force and placing said first roller against said second roller;

providing a detent;

providing a machine frame;

using said detent for limiting a positioning path of said first roller;

providing a counter-bearing on said machine frame;

engaging said detent with said counter-bearing; and performing a follow-up on said detent until said detent comes into contact with said counter-bearing.

13. The method of claim 12 further including introducing a fixing force and applying said fixing force against said first roller and causing said detent and said counter-bearing to rest firmly against each other.

14. A method for adjusting a roller in a printing press including:

supporting said roller for movement in the printing press;

providing a piezo-electric operating device for moving said roller;

providing a detent;

using said detent for limiting said movement of said roller;

applying a first force on said roller using said piezo-electric operating device during production of the printing press; and applying a second force on said roller using said piezo-electric operating device during positioning of said roller.

15. A method for adjusting a roller in a printing press including:

supporting said roller for movement in the printing press;

providing an electrochemical operating device for moving said roller;

providing a detent;

using said detent for limiting said movement of said roller;

applying a first force on said roller said electro-chemical operating device during production of the printing press; and applying a second force on said roller using electro-chemical operating device during positioning of said roller.

* * * * *